United States Patent [19]

Dengel et al.

[11] Patent Number: 4,903,351

[45] Date of Patent: Feb. 27, 1990

[54] SWIMMING POOL WINTERIZING FACEPLATE KIT

[76] Inventors: Robert W. Dengel, 474 Rhode Island Ave.; Robert D. Goelz, 153 Princeton Ave., both of Brick, N.J. 08724

[21] Appl. No.: 270,196

[22] Filed: Nov. 14, 1988

[51] Int. Cl.[4] ..... E03H 3/18

[52] U.S. Cl. ..... 4/496; 4/507; 4/508

[58] Field of Search ..... 4/490, 496, 506, 507, 4/508, 293, 241, 242; 220/3.4, 241, 242

[56] References Cited

U.S. PATENT DOCUMENTS

| | | | |
|---|---|---|---|
| D. 229,310 | 11/1973 | Welborn | D23/209 |
| D. 259,739 | 6/1981 | Johnson | D25/2 |
| 2,900,079 | 8/1959 | Pace | 210/169 |
| 2,936,091 | 5/1960 | Clark | 220/3.4 |
| 3,445,973 | 5/1969 | Stone | 4/293 |
| 3,733,621 | 5/1973 | Junnuzzi, Jr. | 4/506 |
| 3,831,897 | 8/1974 | Stegmeier | 4/490 X |
| 4,126,925 | 11/1978 | Jacuzzi | 4/490 X |
| 4,140,634 | 2/1979 | Harry | 182/150 |
| 4,233,697 | 11/1980 | Cornwall | 4/293 |
| 4,649,579 | 3/1987 | Blais | 4/507 |

*Primary Examiner*—Henry K. Artis

*Attorney, Agent, or Firm*—Fleit, Jacobson, Cohn, Price, Holman & Stern

[57] ABSTRACT

A winterizing kit for swimming pools and more specifically a winterizing faceplate kit for both inground and aboveground swimming pools to greatly reduce the efforts required in the preparation of a swimming pool for active use or for winterizing. A skimmer faceplate is installed on the wall of the swimming pool which provides for both the mounting of a skimmer and a winter cover when required with the present kit eliminating the necessity to drain and refill the pool each time the pool is opened in the spring or closed in the fall. The faceplate includes a gasket arrangement and other components including a faceplate, winterizing cover and necessary mounting bolts and screws to secure the components in position on the swimming pool.

2 Claims, 1 Drawing Sheet

SWIMMING POOL WINTERIZING FACEPLATE KIT

BACKGROUND OF THE INVENTION

1. Field of the Invention

The present invention generally relates to a winterizing kit for swimming pools and more specifically a winterizing faceplate kit for both inground and aboveground swimming pools to greatly reduce the efforts required in the preparation of a swimming pool for active use or for winterizing. A skimmer faceplate is installed on the wall of the swimming pool which provides for both the mounting of a skimmer and a winter cover when required with the present kit eliminating the necessity to drain and refill the pool each time the pool is opened in the spring or closed in the fall. The faceplate includes a gasket arrangement and other components including a faceplate, winterizing cover and necessary mounting bolts and screws to secure the components in position on the swimming pool.

2. Information Disclosure Statement

Devices to serve as a shield for the skimmer throat of a swimming pool are generally known and the following patents are somewhat relevant to the invention.

Des. 229,310
Des. 259,739
2,900,079
3,831,897
126,925
4,140,634
4,649,579

None of the above listed patents discloses a cover plate for the skimmer throat of a swimming pool in which the cover plate is secured to an existing faceplate with the existing faceplate being modified to enable the cover plate and a sealing gasket to be mounted thereon without removing the faceplate.

SUMMARY OF THE INVENTION

An object of the present invention is to provide a swimming pool winterizing faceplate kit which includes a cover plate to form a cover for the skimmer throat of a swimming pool in which the cover plate is secured to the faceplate with a gasket between the cover plate and the faceplate to sealingly secure the cover plate by the use of fastening screws extending through the cover plate into the faceplate with the only modification of the existing faceplate being the provision of screw threaded apertures or bores for receiving the screws which secure the cover plate in place.

Another object of the invention is to provide a winterizing kit for swimming pools which will greatly reduce the effort required in the preparation of a swimming pool for active use in the spring or for winterizing the pool in the fall thereby eliminating the necessity of draining the pool in the fall and refilling it in the spring.

A further object of the invention is to provide a winterizing kit which greatly simplifies the semi-annual practice of converting a swimming pool and skimmer assembly to either an active or inactive status. Since the skimmer throat is normally partially submerged, the present recommended procedure is to drain the water to below the skimmer opening which is located in the side of the pool panel which allows for the conventional installation of the skimmer when the pool is being prepared for active use in the spring or its removal when the pool is to be closed in the fall. There are presently winter covers available to cover the pool in winter if desired but it still is necessary to drain some water from a pool. Thus, there is a loss of water in both the spring and fall. This practice is eliminated when the conventional skimmer faceplate is replaced by the faceplate and cover of this invention which permits the installation of a cover plate in the fall and its removal in the spring without undue effort.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
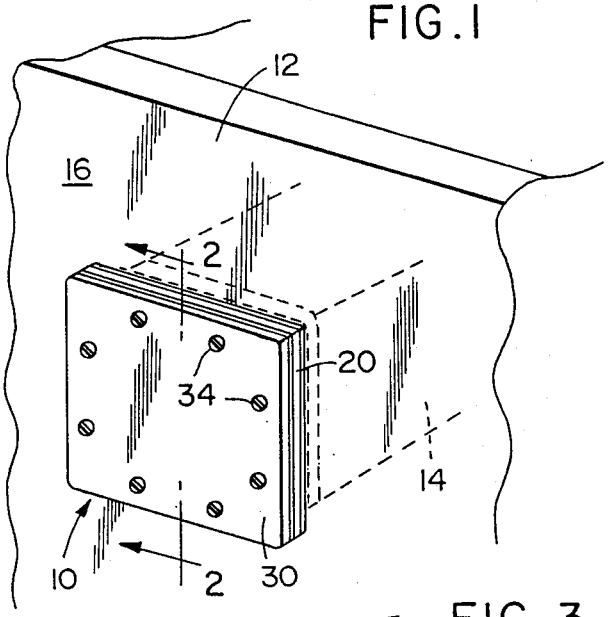
FIG. 1 is a perspective view of the winterizing kit of the present invention installed in a swimming pool.
Figure 2:
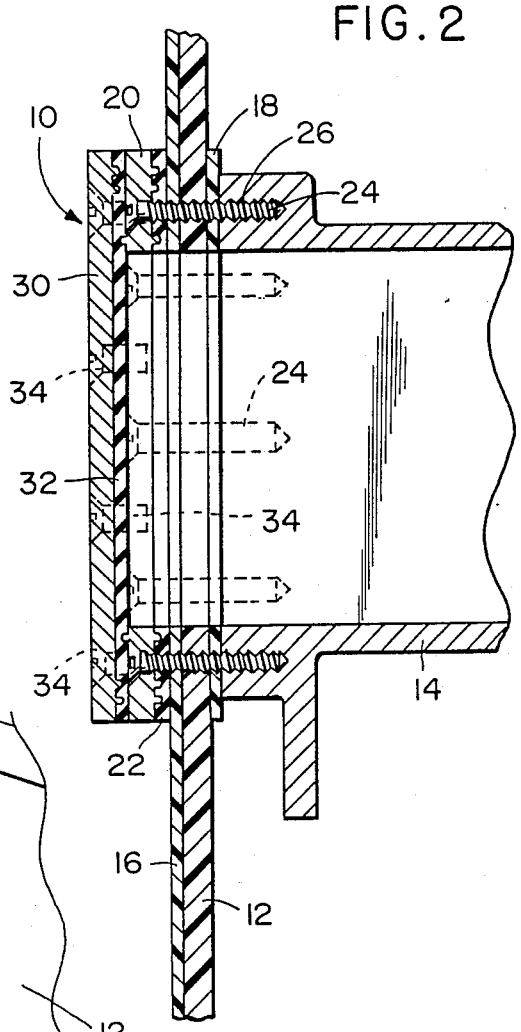
FIG. 2 is a vertical, sectional view, on an enlarged scale, taken substantially upon a plane passing along section line 2—2 on FIG. 1 illustrating the specific structural details of the winterizing kit when installed.
Figure 3:
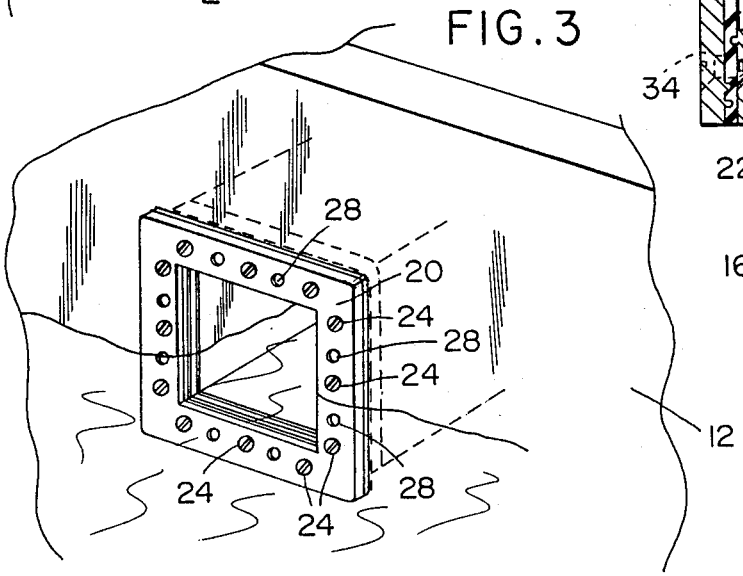
FIG. 3 is a perspective view of the modified faceplate which has been installed on the skimmer throat ready to receive the cover plate.
Figure 4:
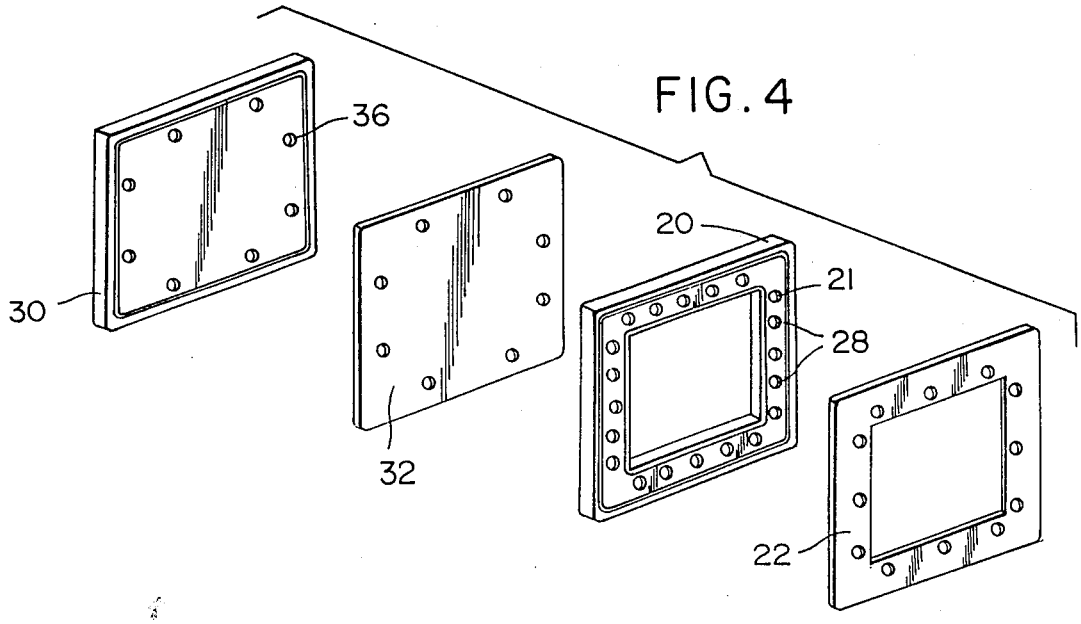
FIG. 4 is an exploded group, perspective view of the components of the winterizing kit of this invention.

Referring now specifically to the drawings, the winterizing kit is generally designated by reference numeral 10 and is illustrated installed in FIG. 1 alongside the wall 12 of the swimming pool in closed relation to a skimmer throat 14 which constitutes a conventional component of a swimming pool in which the pool wall or panel 12 is provided with a vinyl liner 16. The skimmer throat 14 is provided with a gasket 18 between the skimmer throat and the pool wall or panel 12 and a faceplate 20 is positioned at the outer surface of the pool wall and liner and provided with a gasket 22 between the faceplate and the vinyl liner 16. Faceplate securing screws 24 extend through the faceplate 20, gasket 22, vinyl liner 16, pool wall or panel 12 into internally threaded bores or recesses 26 formed in the periphery of the skimmer throat 14 as illustrated in FIG. 2. The aforementioned and described structure is conventional swimming pool structure with the only modification of the existing structure being the faceplate 20 that is provided with a plurality of internally threaded bores or recesses 28 therein in spaced relation to the securing screws 24 as illustrated in FIGS. 3 and 4.

The kit 10 also includes a cover plate 30 of the same shape and size as the faceplate 20 with the cover plate overlying and closing the central opening in the faceplate 20 thus forming a closure for the skimmer throat 14. A gasket 32 is positioned between the inner surface of the cover plate 30 and the outer surface of the faceplate 20 and a plurality of securing fastening screws 34 extend through the cover plate 30 and gasket 32 into the internally threaded bores or apertures 28 into faceplate 20 thereby securing the cover plate in closed and sealed relation to the faceplate 20. As illustrated in FIG. 4, the kit includes the gasket 22, faceplate 20, gasket 32 and cover plate 30 and each of these components includes preformed apertures with the apertures or bores 28 in the faceplate 20 being internally threaded. The apertures in the cover plate 30 which are designated by reference numeral 36 are countersunk on the outer surface to enable the securing screws 34 to have their heads flush with the outer surface of the cover plate 30. Also, the apertures in the faceplate 20 which are designated by reference numeral 21 are also countersunk on the outer surface thereof to receive the heads of the securing screws 24 so that a smooth external surface is provided on the faceplate 20 when it is installed. The gasket 32 is actually a square panel of the same shape and size as the faceplate 20 and cover plate 30 and both the faceplate 20 and the cover plate 30 includes a peripheral rib to engage the resilient gasket material of the gaskets 22 and 32 with the cover plate 30 including a single rib on the inner surface and the faceplate 20 including two concentric ribs on both surfaces with the inner rib defining the large central opening in the faceplate 20 which corresponds with the enlarged central opening in the gasket 22 as well as the opening through the vinyl liner 16, the pool wall 12, the gasket 18 and the skimmer throat 14.

With the present invention, the faceplate 20 is a permanent installation and the gasket 32 and cover plate 30 are easily and quickly installed for winterizing a swimming pool and returning it to active use. By leaving the faceplate permanently in position, the usual procedure of removing the faceplate to install a cover for the skimmer throat is eliminated with it only being necessary to merely install the gasket 32 and cover plate 30 in place. Thus, in effect, the procedure has been simplified by eliminating the necessity of the usual step of removing the faceplate in order to install a cover for the skimmer throat. This also eliminates the need to lower and raise the water level in the pool in order to install the presently used winter gasket and cover thereby saving water, time, money and effort. In conventional practice, because the skimmer throat is normally partially submerged, the present recommended procedure in the spring and fall is to drain the water to below the skimmer throat opening which is located in the side of the pool panel. This allows for the conventional installation of the skimmer when the pool is being prepared for active use in the spring or its removal when the pool is to be closed in the fall. There are presently available winter covers to cover the pool wall opening during the wintertime if desired. Approximately, 1,000 gallons of water are drained from an average 24' diameter aboveground pool each spring and fall and this same amount is pumped back into the pool each spring and fall after a conventional skimmer cover is put in place. This chemically treated winterized water is usually drained into the environment via the user's yard. This conventional pump down and refill practice is eliminated when the conventional skimmer faceplate is replaced by the use of this invention. The one-time installation of the faceplate without a change to the skimmer permits the installation of a cover plate in the fall and its removal in the spring, thereby enabling the protective skimmer cover plate to protect the skimmer throat and other components from harsh environments and prevents debris and water from entering the skimmer throat during periods of non-use without requiring the water level to be lowered. The faceplate 20 and cover plate 30 may be constructed of conventional material such as metal or plastic and the gaskets are also constructed of resilient waterproof material such as rubber, plastic and the like. The size dimensions are commensurate with existing skimmer throat structures with the faceplate 20 being duplicative of existing faceplates except that the screw threaded bores 28 have been added which enables installation of the gasket 32 and cover plate 30 by the use of the fastening screws 34. If the faceplate is constructed of plastic, metal inserts may be placed therein where bores 28 occur with the inserts having an internally threaded bore therein which will be longer lasting as compared to threads formed in plastic.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A winterizing kit for a swimming pool which includes a skimmer throat connected to a side wall of the swimming pool and communicated with the interior of the swimming pool through an opening in the side wall of the swimming pool to provide flow water into the skimmer throat during use of the pool, an annular faceplate extending peripherally of the opening in the wall of the pool, said faceplate being positioned interiorly of the wall, an annular gasket between the faceplate and pool wall and fasteners extending through the faceplate, gasket, pool wall and connected to the skimmer throat to permanently secure the faceplate to the interior of the pool wall and skimmer throat, said kit comprising said faceplate being provided with internally threaded bores therein spaced from the fasteners extending through the faceplate, a cover plate overlying the faceplate and forming a closure for the annular faceplate and opening, a gasket interposed between the cover plate and faceplate, and fastening means extending through the cover plate and gasket and into the threaded bores in the faceplate without extending inwardly of the faceplate for removably securing the cover plate and gasket to the faceplate in sealed relation to form a closure for the opening through the annular faceplate, annular gasket, opening in the wall and skimmer throat to prevent entry of chemically treated water, debris and the like into the skimmer throat during periods of non-use of the swimming pool with the skimmer throat being closed by installation of the cover plate and gasket onto the faceplate without removing or altering the faceplate, said cover plate being an imperforate plate having a periphery generally coinciding with the periphery of the annular faceplate, the gasket between the cover plate and faceplate being an imperforate resilient member forming a seal between the cover plate and faceplate, said fastening means removably securing the cover plate to the faceplate including screw threaded fasteners extending through apertures in the cover plate and imperforate gasket, said internally threaded bores in the faceplate receiving the inner ends of the screw threaded fasteners without extending inwardly of the faceplate to secure the cover plate and gasket in place in sealed relation to the faceplate.

2. The structure as defined in claim 3 wherein the screw threaded fasteners are flat headed screws and the external surface of the cover plate is provided with countersunk apertures receiving the fasteners to provide a smooth external surface to the cover plate facing inwardly of the pool when the cover plate, gasket and fastening screws have been installed on the faceplate, said skimmer throat, opening in the pool wall, faceplate and gasket, cover plate and gasket being of polygonal configuration, with the faceplate and cover plate being constructed of rigid material and the gaskets being constructed of resilient material, the surfaces of the faceplate and cover plate engaging the gaskets including peripheral ridge means forming a more effective sealing engagement with the gaskets.

* * * * *